United States Patent [19]

Bruhn et al.

[11] 4,257,579

[45] Mar. 24, 1981

[54] WASTE HEAT RECOVERY PROCESS AND APPARATUS

[75] Inventors: Alfred Bruhn, East Chester, N.Y.; William Bernard, Winnetka, Ill.

[73] Assignee: American Hydrotherm Corp., New York, N.Y.

[21] Appl. No.: 2,688

[22] Filed: Jan. 11, 1979

Related U.S. Application Data

[63] Continuation of Ser. No. 813,169, Jul. 5, 1977, abandoned, which is a continuation-in-part of Ser. No. 768,087, Feb. 14, 1977, abandoned.

[51] Int. Cl.[3] ..... C21B 9/00; F28D 21/00

[52] U.S. Cl. ..... 266/141; 237/56; 165/104 M; 165/104 S; 165/107 R; 165/DIG. 12

[58] Field of Search ..... 266/144, 155, 141, 159; 165/104 M, 104 S, 107, 1, DIG. 12; 34/86; 237/56

[56] References Cited

U.S. PATENT DOCUMENTS

| | | | |
|---|---|---|---|
| 2,794,631 | 6/1957 | Becker et al. | 266/141 |
| 2,910,244 | 10/1959 | Payne | 237/56 |
| 3,258,204 | 6/1966 | Smith, Jr. | 237/56 |
| 3,479,021 | 11/1969 | Escher | 266/159 X |
| 3,623,549 | 11/1971 | Smith, Jr. | 165/107 |

*Primary Examiner*—Albert W. Davis

*Attorney, Agent, or Firm*—Louis E. Marn; Elliot M. Olstein

[57] ABSTRACT

There is disclosed a process and apparatus for the recovery of heat from exhaust or waste gases having a temperature of from about 500° F. to about 2500° F. generated in a process operation having at least two heat recovery assemblies, each utilizing like or different intermediate heat transfer mediums to recover heat at higher heat temperature levels.

9 Claims, 1 Drawing Figure

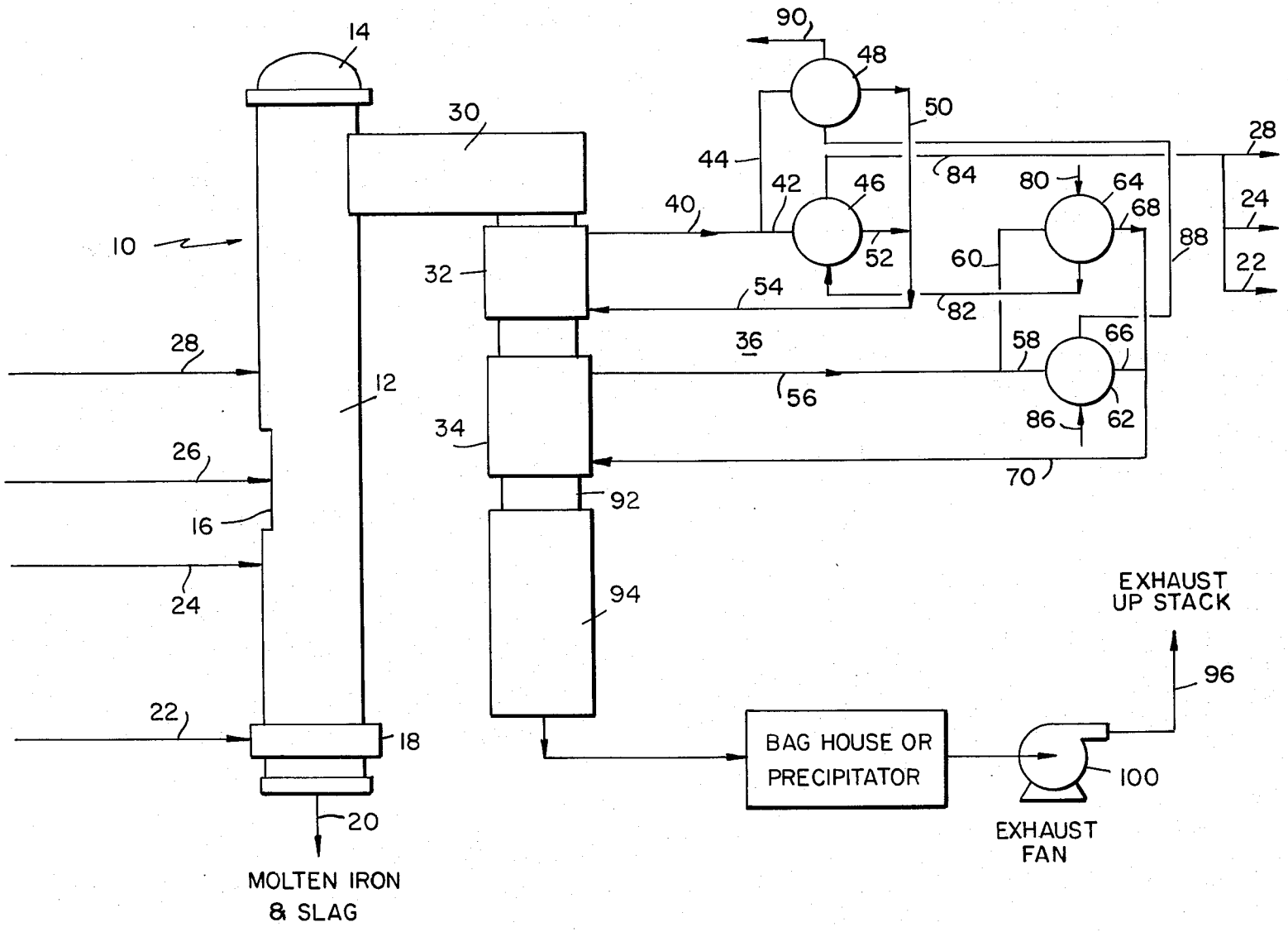
EXHAUST UP STACK
BAG HOUSE OR PRECIPITATOR
EXHAUST FAN
MOLTEN IRON & SLAG

WASTE HEAT RECOVERY PROCESS AND APPARATUS

This application is a continuation of application Ser. No. 813,169, filed 7/5/77 now abandoned, which is a continuation-in-part of U.S. Application Ser. No. 768,087 filed Feb. 14, 1977 now abandoned and assigned to the assignee as the present-invention.

This invention relates to waste heat recovery, and more particularly to a process and apparatus for the recovery of heat from high temperature gases.

Heat exchange is an important aspect of essentially all process operations whether at high or low temperature processing conditions. Economics normally dictate effective utilization of heat transfer equipment with respect to processing streams. Waste heat recovery generally relates to the recovery of heat over and above basic heat requirements, e.g. in steam generation equipment, there are normally a convection section disposed in the equipment whereat the temperature level is insufficient for steam generation but at a level where sensible heat is available for heating duty, such as preheating water to be passed to a steam drum. There are some processing operations where heat is available for recovery, but is not effectively recovered, if at all, e.g., the operation of a cupola.

In a typical foundry operation, coke, limestone and a metallic portion, such as pig and scrap iron are introduced through a charge door into a cupola. Cold blast air is introduced through tuyeres in the bottom provide the combustion medium for the coke. Additional air is induced through the charge door by an exhaust fan. Afterburners located above the charge door provide a source of ignition for carbon monoxide leaving the bed and for providing heat for the cupola when the cupola is not in production. Air entering the cupola in the form of blast air, charge door air, and afterburner air is normally cold and is heated to operating temperature by consuming fuel at the afterburners or by consuming coke in the lower portion of the cupola.

Hot gases at a temperature of from about 1800° F. to about 2200° F. are withdrawn from the top of the cupola and are generally passed to vertically disposed water scrubber wherein the gas is cooled to a temperature of from 400° to 500° F. prior to introduction into a solids collector, e.g., an electrostatic precipitator or bag house. With direct water cooling and scrubbing, a large quantity of steam is produced which increases the volume of gas through the downstream equipment.

Heat recovery systems have been installed in a small number of plants in the form of either a recuperative or regenerative type of heat recovery systems. With a recuperative type, expensive high alloy heat exchanger is employed to cool the hot gas by heating the blast air. This type of heat exchanger is very expensive due to the high alloy construction needed to withstand the high metal temperature (1800° F. to 2200° F.) and the large amount of heat transfer surface as a result of the poor heat transfer coefficient of hot gas to cool air. The recuperative type is subject to mechanical failures due to the frequent wide swings in temperatures from 1300° F. to 2000° F. which can occur as much as 14 times a day with swings ranging from ambient to 2000° F. occurring with the daily startup and shutdown routine.

In the regenerative type, an expensive mesh wheel rotates and is alternately heated by hot gas and cooled by cool air. This type of heat exchanger is very large and is the source of much maintenance and plant shutdowns due to seal failures and corrosion where cold air condenses moisture and sulfur dioxide from the hot gas.

Both the recuperative and regenerative type of waste heat recovery systems effectively function only when the plant is at operating temperatures, i.e., 1800° F. to 2000° F. (gas temperature) and large amounts of blast air are needed. During idle time, when the afterburners are holding the cupola at around 1300° F. and no blast air is required, neglible heat is recovered. Idle time can amount to 8 hours per day or as much as 12 hours per day. Corresponding melting time would only be 8 hours or 4 hours with effective heat recovery time of 8 or 4 hours per day. Generally, such systems were limited to recovery heat necessary for preheating combustion air to reduce fuel requirements. Some process operations require gas fired auxiliary equipment since fuel oil firing produces a dirty or sooty exhaust gas which could not be tolerated by the process operation.

In aforementioned copending application, there is disclosed a heat exchange recovery system utilizing a molten substance, such as an eutectic salt system, as an intermediate heat transfer medium for a process operation, such as the operation of a cupola in which there is produced an exhaust or waste gas at temperatures of from 500° F. to 2500° F. By using such a system, the heat exchanger unit thereof may be fabricated using conventional materials of construction vice more expensive, high alloys materials of construction. Utilizing such a heat exchange system limits the temperature level at which the heat may be recovered.

OBJECTS OF THE INVENTION

An object of the present invention is to provide a novel process and apparatus for a heat recovery system for a process operation from which a waste heat gas is withdrawn at elevated temperature.

Another object of the present invention is to provide for a novel heat recovery system for a process operation operating at elevated temperatures and having operation and standby modes of varying time durations.

Still another object of the present invention is to provide for a novel heat recovery system for recovering heat at higher temperature levels from a high temperature gas.

A still further object of the present invention is to provide a novel heat recovery system.

SUMMARY OF THE INVENTION

These and other objects of the present invention are achieved using at least two heat exchange recovery systems utilizing intermediate heat transfer mediums for a process operation, such as the operation of a cupola in which there is produced an exhaust or waste gas at temperatures of from 500° F. to 2500° F. By using such a system, the heat exchanger unit thereof may be fabricated using conventional materials of construction vice more expensive, high alloys materials of construction, and heat may be recovered at levels substantially higher than with the use of a single intermediate heat transfer medium, such as disclosed in the aforementioned continuation-in-part application.

BRIEF DESCRIPTION OF THE DRAWING

The invention will be more clearly understood by reference to the following description of an exemplary embodiment thereof in conjunction with the accompanying drawing illustrating a schematic flow diagram.

DETAILED DESCRIPTION

Referring to the drawing, there is illustrated a cylindrical shaped cupola, generally indicated as 10, comprised of a vessel 12 provided with an upper hemispherically cover 14, a charge door 16, a tuyere 18, and a molten iron draw-off assembly, generally indicated as 20. The vessel 12 is provided with hot blast air line 22, charge door air line 24, charge door draft line 26 open to the outside and an afterburner line 28. The upper portion of the vessel 12 is provided with a cross over duct 30 in fluid communication with a primary and secondary heat exchangers 32 and 34, respectively, of the heat recovery system, generally indicated as 36.

The heat recovery system 34 may also include a salt tank (not shown), such as described in the aforementioned co-pending application, should molten salt constitute one of the intermediate heat transfer fluids. The primary heat exchanger 32 is in fluid communication by a conduit 40 and with conduits 42 and 44 with the tube or shell side of heat exchangers 46 and 48, respectively. The outlet from the primary heat transfer medium side of heat exchangers 46 and 48 are in fluid communication by conduits 50 and 52, respectively, with conduit 54 via storage tank 56 to the primary heat exchanger 32. The secondary heat exchanger 34 is in fluid communication by a conduit 56 and with conduits 58 and 60 with the tube or shell side of heat exchangers 62 and 64, respectively. The outlet from the heat exchangers 62 and 64 are in fluid communication by conduits 66 and 68, respectively, which combine in conduit 70 via storage tank 72 for return flow to the secondary heat exchanger 34. A conduit 80 containing a fluid to be heated is in fluid flow communication with exchangers 64 and 46 by conduit 82, with the outlet from heat exchanger 46 being conduit 84 which is divided into conduits 28, 24 and 22. A conduit 86 containing another fluid to be heated is in fluid flow communication with exchangers 62 and 48 by conduit 88, with the outlet from heat exchanger 48 being in fluid flow communication with a conduit 90.

The outlet from the secondary heat exchanger 34 is passed by conduit 92 to a wet scrubber 94 and vented to the atmosphere by line 96 via precipitator 98 and exhaust fan 100.

In operation the heat recovery system 36, with its intermediate heat transfer fluids is used to recover heat from the exhaust hot gas, store the heat during the cyclic operation of melting and idling, and utilize the heat in a variety of ways including heating the blast air, burner air, and charging door air; and generating steam.

Example of the Invention

Operation of the process and apparatus is described in the following examples which were intended to be merely illustrative and the invention is not to be regarded as limited thereto.

EXAMPLE I

The following Table I set forth conditions of cupola operating at 8,000 scfm blast air; 8,000 scfm charge door indraft, and at an 1800° F. stack gas temperature for 6000 hours per year. A heat recovery system of the present invention installed to cool the stack gas to 400° F. with recovered heat being used to produce steam and to reduce consumption of gas and coke would realize an annual saving of over $400,000. The intermediate heat transfer medium in the primary and secondary heat transfer vessels 32 and 34 is a salt mixture and water, respectively.

TABLE 1

| Conduits | °F. | Flow Rate #/hr. |
|---|---|---|
| line 30 | 1800 | 75,791 |
| line 40 | 850 | 372,000 |
| line 54 | 700 | 372,000 |
| line 56 | 400 | 78,700 |
| line 70 | 300 | 78,700 |
| line 22 | 750 | 36,624 |
| line 24 | 750 | 18,312 |
| line 28 | 750 | 2,812 air |

The following Table II set forth operating conditions of such a cupola in an idling mode.

TABLE II

| Conduits | °F. | Flow Rate #/hr |
|---|---|---|
| 22 | — | 0 |
| 24 | 450° F. | 18,312 |
| 28 | 450 | 10,163 (air) |
| 30 | 1300 | 47,807 |
| 40 | 566 | 372,000 |
| 54 | 500 | 372,000 |
| 56 | 331 | 78,700 |
| 70 | 300 | 78,700 |

The cupola of Example I similarly operated with an intermediate heat transfer oil used in the primary and secondary exchangers has the conditions set forth in the following Table III:

TABLE III

| Conduit | °F. | Flow Rate #/hr |
|---|---|---|
| 22 | 600° F. | 36,624 |
| 24 | 600 | 18,312 |
| 28 | 600 | 2,312 (air) |
| 30 | 1800 | 75,791 |
| 40 | 700 | 349,000 |
| 54 | 600 | 349,000 |
| 56 | 400 | 134,000 |
| 70 | 300 | 134,000 |

An idling mode conditions are set forth in the following Table IV:

TABLE IV

| Conduit | °F. | Flow Rate #/hr |
|---|---|---|
| 22 | — | 0 |
| 24 | 400 | 18,312 |
| 28 | 400 | 10,163 (air) |
| 40 | 442 | 432,000 |
| 54 | 400 | 432,000 |
| 56 | 331 | 142,000 |
| 70 | 300 | 142,000 |

It is noted that the temperature of the air streams of Examples I and II are different whereas the exhaust gas temperature and flow are the same—the difference being varying fuel requirements.

The heat recovery system of the present invention greatly improves the design, operation and maintenance of pollution control system (i.e. wet scrubber, electrostatic precipitator, bag house or mechanical collector) associated with various processes, since there is realized a substantial reduction in gas volume.

Installation in an existing foundry cupola having a wet scrubber system, the sensible cooling of the stack gas prior to quenching in the scrubber substantially reduces water consumption. This reduction in water evaporation greatly reduces the volume and weight of saturated gas which the system fan must handle. Thus, there is 31% reduction in volume flow by cooling the gas from 1800° F. to 500° F., by heat recovery instead of direct spray water cooling.

While the present invention has been discussed with reference to the incorporation of a heat recovery system in combination with a cupola, it will be understood that such system may be used with any metallurgical, chemical, or refinery process and particularly useful with processes which produce hot, dirty gas containing fines which have to be separated in dust removal equipment before being exhausted to the atmosphere. Since prior to passage through dust removal equipment, the hot, dirty gas must be cooled to 400°-500° F., the process and apparatus of the present invention provides a particularly economically attractive alternate to presently practical techniques. Additionally, more than two heat exchangers may be disposed in tandum utilizing intermediate heat transfer fluids at different temperature levels, e.g., molten salt, oil and water, or molten salt, oil and oil, etc. The operating temperature of the heat transfer fluids, are dependent on the thermal stability properties for salt and oil (normally 1000° F. and 600° F., respectively) and the vapor pressure for water (normally 400° F. at 247 psia vapor pressure).

While the invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

We claim:

1. In a process for recovering heat from an exhaust gas having a temperature of from 500° to 2500° F. generated in a unit operation effecting an exothermic reaction and cycling between an operational mode and an idling mode, the improvement comprising:

(a) passing said exhaust gas during said operational mode in indirect heat transfer relationship to at least two intermediate heat transfer media in at least two successive heat exchange zones operating at different temperature levels;

(b) recovering heat from said intermediate heat transfer media at different temperature levels;

(c) passing one intermediate heat transfer media through a first heat transfer zone;

(d) passing another intermediate heat transfer medium having a lower operational temperature level through a succeeding heat transfer zone;

(e) passing an air stream sequentially through said succeeding heat transfer zone and said first heat transfer zone to preheat said air stream;

(f) introducing said preheated air into said unit operation;

(g) passing said intermediate heat transfer media to respective storage zones (h) during the idling mode passing said intermediate heat transfer media from said storage zones to a user other than the unit operation; and (i) passing to step (a) said intermediate heat transfer media from said storage zones.

2. The process as defined in claim 1 wherein said unit operation is a cupola for producing iron.

3. The process for effecting the operation of a cupola as defined in claim 2 wherein said preheated air stream provides the blast air and charge door air requirements of said cupola during said operational mode.

4. The process for effecting the operation of a cupola as defined in claim 3 wherein said exhaust gas is at a temperature of from 1800° to 2200° F. and is cooled to a temperature of from about 400° to 500° F.

5. The process for effecting the operation of a cupola as defined in claim 2 wherein said preheated air stream provides afterburner air requirements during said idling mode.

6. The process of claim 1 wherein one of said intermediate heat transfer media is a molten salt and a diluent is added to said molten salt in said storage zone during shut-down operation.

7. The process of claim 1 wherein a portion of said heated intermediate heat transfer media is used to generate steam.

8. The process of claim 7 wherein said generated steam is used for space heating.

9. The process of claim 7 wherein said generated steam is used to provide the steam requirements for a steam turbine.

* * * * *

UNITED STATES PATENT AND TRADEMARK OFFICE

CERTIFICATE OF CORRECTION

PATENT NO. : 4,257,579

DATED : March 24, 1981

INVENTOR(S) : Alfred Bruhn et al.

It is certified that error appears in the above—identified patent and that said Letters Patent is hereby corrected as shown below:

The title page and the sole sheet of drawing should be deleted to insert the attached title page and the sheet of drawing.

Signed and Sealed this

*Eighth* Day of *December 1981*

[SEAL]

*Attest:*

GERALD J. MOSSINGHOFF

*Attesting Officer*

*Commissioner of Patents and Trademarks*